US005165529A

United States Patent [19]

Fujiyoshi

[11] Patent Number: 5,165,529

[45] Date of Patent: Nov. 24, 1992

[54] SWITCH

[75] Inventor: Shiori Fujiyoshi, Yokohama, Japan

[73] Assignee: Jimbo Electric Co., Ltd., Tokyo, Japan

[21] Appl. No.: 457,563

[22] Filed: Dec. 27, 1989

[30] Foreign Application Priority Data

Dec. 28, 1988 [JP] Japan ..... 63-334872

[51] Int. Cl.[5] ..... H01H 1/02; H01H 1/26

[52] U.S. Cl. ..... 200/267; 200/246; 200/275; 200/283; 200/553

[58] Field of Search ..... 200/553, 246, 339, 267, 200/283, 275, 401, 262

[56] References Cited

U.S. PATENT DOCUMENTS

| | | | |
|---|---|---|---|
| 3,392,250 | 7/1968 | Ziegler et al. | 200/283 |
| 3,940,964 | 3/1976 | Todorki et al. | 72/177 |
| 4,293,753 | 10/1981 | Kanada | 200/315 |
| 4,383,149 | 5/1983 | Fulton | 200/267 |
| 4,808,778 | 2/1989 | Fujiyoshi | 200/339 |

*Primary Examiner*—Ernest G. Cusick
*Assistant Examiner*—Glenn T. Barrett
*Attorney, Agent, or Firm*—Wegner, Cantor, Mueller & Player

[57] ABSTRACT

A switch comprises a housing having an upper member and a lower member, an actuator disposed in the housing and rockably supported on the upper member, switch means for connecting and disconnecting a movable contact with a stationary contact when the actuator rocks on the upper portion, and a connecting terminal for an external electric wire electrically connected to the switch means. The switch means includes a movable contact element having the movable contact and a support element which rockably supports the movable contact element. At least one of portions contacting each other between the support element and the movable contact element is provided with a clad layer of a high conductive noble metal which extends in the rocking direction at the width less than that of the contacting portions.

5 Claims, 5 Drawing Sheets

SWITCH

BACKGROUND OF THE INVENTION

1. Field of the Invention

This invention relates to a switch in which a movable contact is connected to and disconnected from a stationary contact by a rocking action of an actuator.

2. Statement of the Prior Art

Heretofore, a kind of such a switch is disclosed, for example, in Japanese Utility Model Publication No. 35150/1985.

The prior switch comprises a switch body, a switch handle, a base plate on the backside of the handle, a resistor for protection of limited flow, an indication lamp, a pattern face having two ways of conductive layer formed on the backside of the base plate, a load terminal device, an indication circuit terminal device, and a power source terminal device. The load terminal device and the indication circuit terminal device are electrically connected through a contact spring to the base plate. A switching means is disposed among the load terminal device, the indication circuit terminal device, and the power source. The connection between the devices is turned on and off by operation of the handle to electrically connect a serial circuit comprising the resistor for protection of limited flow and the indication lamp.

In the prior switch, a contact element of the switch means and a contact plate connected to a terminal plate are made of a copper alloy sheet. When the contact element and plate is heated above a given temperature by sparks therebetween, a thin layer of copper peroxide is generated on the surface of the contact element and plate to increase the electric resistance and this results in generation of a further high temperature.

In particular, when the prior switch is used for a load of a high power factor type of a fluorescent lamp, an over-current flows on throwing the switch to generate sparks and to melt the contacts. Finally, it becomes impossible to disconnect the contacts.

In order to overcome such problem, it may be contemplated to make either contact element or contact plate with a high conductive noble metal such as silver. However, since the silver itself is not only precious but also soft, there still remains a problem that contacting portion is readily worn by rocking action of the contact element.

In addition, in the prior switch, a movable frame is bridged between a rotary shaft to be actuated by the switch handle and the terminal plate to be pivoted by the switch body, and the rotary shaft activates the movable frame. This construction makes the assembling work very complicated and requires great skill.

SUMMARY OF THE INVENTION

An object of this invention is to provide a switch which has improved contacts with durability and reliability, positively connects and disconnects the contacts, and can be easily assembled.

A switch of this invention comprises a housing having an upper member and a lower member, an actuator disposed in said housing and rockably supported on said upper member, switch means for connecting and disconnecting a movable contact with a stationary contact when said actuator rocks on the upper portion, and a connecting terminal for an external electric wire electrically connected to said switch means, said switch means including a movable contact element having said movable contact and a support element which rockably supports said movable contact element, at least one of the portions contacting each other between said support element and said movable contact element being provided with a clad layer of a high conductive noble metal which extends in the rocking direction at the width less than that of said contacting portions.

When one end of the rockable actuator is pushed down, the movable contact element is rocked in one direction, since the movable contact element is rockably supported between the support element biased by a resilient element and the actuator. Consequently, the movable contact on the movable contact element is connected to or disconnected from the stationary contact on the lower member. A current flows through the switch means between the external electric wires. A major part of the current flows collectively through the clad layer of the high conductive noble metal on a part of the portions contacting the movable contact element of the switch means with the support element. Accordingly, the generation of heat in the contacting portion is effectively suppressed.

The support element includes a leaf spring comprising a connecting piece, legs extending downwardly from an end of said connecting piece, V-shaped piece connected to the upper portion of said legs. The legs provides said V-shaped piece with elasticity.

The leaf spring is bent into a M-shaped body to form legs at both sides of said V-shaped piece thereby providing said V-shaped piece with elasticity having a large value in the vertical direction but a small value in the lateral direction.

The clad layer may be formed on upper face of said support element at the width less than that of the portion contacting with said movable contact element or lower face of said movable contact element or both upper face of said support element at the width less than that of the portion contacting with said movable contact element and lower face of said movable contact element.

DETAILED DESCRIPTION OF THE PREFERRED EMBODIMENTS

Referring now to FIGS. 1 through 6, a first embodiment of a switch in accordance with this invention is explained.

Figure 1:
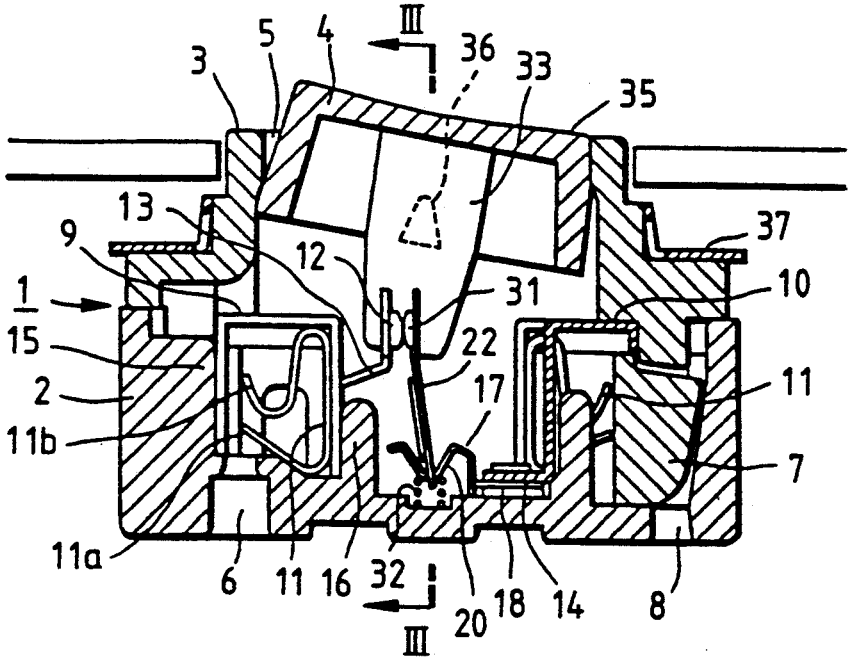
FIG. 1 is a longitudinal cross section of a switch of an embodiment in accordance with this invention.
Figure 2:
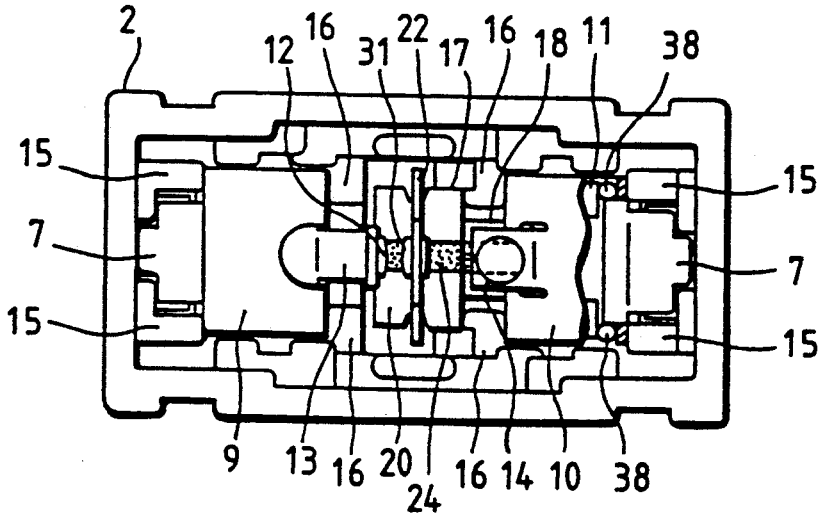
FIG. 2 is a plan view of FIG. 1 to illustrate the inside of a housing by removing an upper member.
Figure 3:
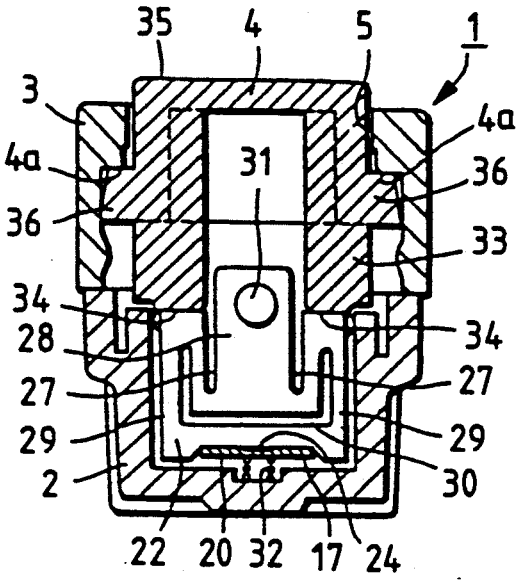
FIG. 3 is a cross section taken from line III—III in FIG. 1.
Figure 4:
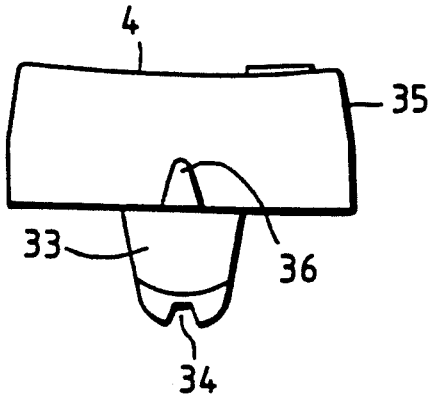
FIG. 4 is a front view showing an example of an actuator of this invention.

In the switch of this invention, as shown in FIGS. 1 through 3, housing 1 has lower member 2 and upper member 3. Operation opening 5 is formed in upper member 3 so that actuator 4 extends outwardly from opening 5. Lower member 2 has at the bottom insert apertures 6 to receive each of electric wires and bottom apertures 8 to receive a tool for operating release buttons 7.

Connecting terminal elements 9, 10, holding springs 11 corresponding to elements 9, 10, and release buttons 7 are disposed in housing 1. Each of connecting terminal elements 9, 10 is formed by bending copper alloy plate in a U-shaped body. Connecting terminal element 9 is formed into contact piece 13 having stationary contact 12 at the top end by bending element 9 outwardly at the middle point in the longitudinal direction. Connecting terminal element 10 is formed into coupling piece 14 by bending element 10 outwardly at the lower end.

Connecting terminal elements 9, 10 are disposed between a pair of lateral protrusions 15 and a pair of vertical protrusions 16 in lower member 2 with the opening of U-shaped body opposing to the bottom of lower member 2. Both protrusions 15 and 16 prevent elements 9 and 10 from deflecting outwardly. Thus, connecting terminal elements 9 and 10 are disposed above insert aperture 6. Holding springs 11 are provided inside of the elements 9, 10. Elements 9, 10 and holding springs 11 form screwless terminals.

As shown in FIGS. 1 and 2, holding springs 11 have anchor ends 11*a*, 11*b* at the opposite ends of the springs so that ends 11*a* and 11*b* can engage electric wires 38 to prevent the wires from coming out of apertures 6. Anchor ends 11*a* and 11*b* are formed by bending holding springs 11 into a U-shaped form at one end thereof and by further bending them into an S-shaped form. Inner end faces of release buttons 7 disposed above tool-insert apertures 8 oppose to the distal ends of both anchor ends 11*a*, 11*b*. By displacing release button 7 to resiliently deflect both anchor ends 11*a*, 11*b* by a tool such as a screw-driver, electric wires 38 clamped between connecting terminal element 9 (or 10) and anchor end 11*b* (or 11*a*) can be released from aperture 6. Coupling piece 14 on connecting terminal element 10 is disposed in lower member 2 with connecting piece 18 of support element 17 being mounted on coupling piece 14 to form an electric connection.

Support element 17 includes a leaf spring comprising connecting piece 18, legs 19 extending downwardly from an end of connecting piece 18, V-shaped piece 20 connected to the upper portion of legs 19. Legs 19 provide V-shaped piece 20 with elasticity. Notches 21 are formed in the both sides of valley of V-shaped piece 20. Narrower portions defined between notches 21 engage notches 23 formed at the lower end of movable contact element 22 to resiliently support movable contact element 22 upwardly.

Figure 5:
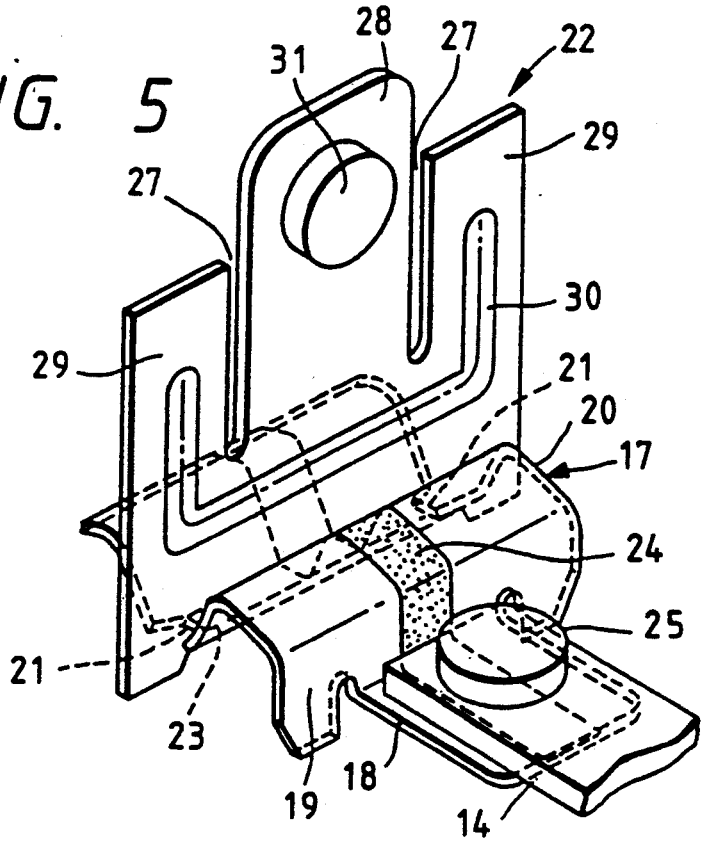
FIG. 5 is a perspective view of a movable contact element and a support element.
Figure 6:
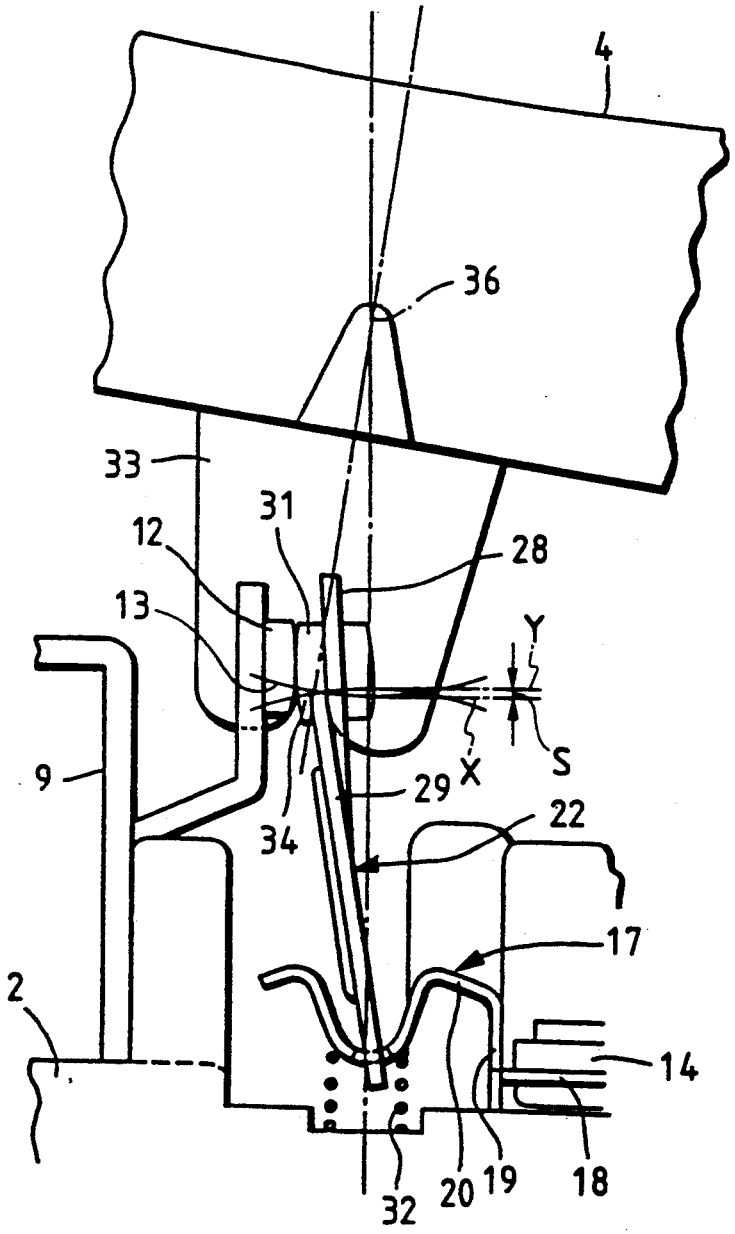
FIG. 6 is an enlarged partial view of FIG. 1.

Further, as shown in FIGS. 3 and 5, clad layer 24 is formed on the upper face of support element 17 at the width less than that of the portion (said narrower portion) contacting with movable contact element 22 and clad layer 24 extends from one end of V-shaped piece 20 to the other end of connecting piece 18 through legs 19. Such clad layer 24 is formed integrally with support element 17 by rolling on support element 17 a high conductive noble metal such as silver. Securing element 25 passes through clad layer 24 to press coupling piece 14 and connecting piece 18 each other.

Movable contact element 22 has two slits 27 formed on the opposite side of notches 26 to define central terminal piece 28 and side pieces 29. U-shaped raised portion 30 formed on side pieces increases the stiffness of side pieces 29 and assures the rocking action of terminal piece 28. Terminal piece 28 has movable contact 31 on one side thereof.

Terminal piece 28 is disposed to oppose to contact piece 13 of connecting terminal element 9. When movable contact element 22 rocks, movable contact 31 contacts with and separates from stationary contact 12.

Coil spring 32 biases V-shaped piece 20 of support element 17 upwardly to movable contact element 22. The biasing forces exerted in support element 17 and coil spring 32 cause the upper edge of side pieces 29 to engage V-shaped groove 34 in the back surface of operation arm 33 of actuator 4 (see FIGS. 3 and 4).

Actuator 4 includes operation block 35 of which upper portion projects from operation opening 5 and operation arm 33 connected to the bottom of operation block 35. Fulcrum portions 36 having a triangular shape are formed at the center of the longitudinal direction of operational block 35 and the opposite sides of the widthwise direction thereof. The upper edge of each fulcrum portions 36 are urged to the bottom of downward divergent groove 4*a* by the biasing force of coil spring 32. Thus, actuator 4 can rocks on the upper edges of fulcrum portions 36 to rock movable contact element 22 in response to the rocking direction.

Switch means comprises stationary contact 12, support element 17, movable contact element 22, movable contact 31 and elastic element 32. Support element 17 and movable contact element 22 are made of a copper alloy sheet with a high conductivity similar to connecting terminal elements 9 and 10. Frame 37 shown in FIG. 1 couples upper member 3 and lower member 2 each other.

The operation of the switch of the first embodiment will be now explained.

FIG. 1 is a cross section which shows contacts 12 and 31 of the switch in the closed condition. When actuator 4 is pushed down at the elevated end (the left end in FIG. 1), actuator 4 turns about fulcrum portion 36 in the counterclockwise direction and operation arm 33 integral with actuator 4 turns in the same direction as that of actuator 4. Thus, side pieces 29 of which the upper edges engage V-shaped groove 34 in the lower end of operation arm 33 turn to the right about the recess of V-shaped piece 20 of support element 17. Consequently, terminal piece 28 having movable contact 31 turns to follow the movement of side pieces 29 with a little time lag. The electric circuit is opened by disconnecting movable contact 31 from stationary contact 12. The right end of actuator 4 is elevated to project from operation opening 5.

In this case, supplied current flows on clad layer 24 collectively, since clad layer 24 is disposed on the center of the upper face of V-shaped piece 20 of support element 17 which contacts with the lower end of movable contact element 22 and clad layer 24 is made of a high conductive noble metal such as silver. On the other hand, the urging force applied to movable contact element 22 by coil spring 32 is almost supported on the portion of a copper alloy on the both sides of clad layer 24 on V-shaped piece 20. Accordingly, the pressure to be received by clad layer 24 can be reduced to a several percentage of the total pressure and the wear of clad layer 24 can be significantly suppressed.

Accordingly, it is possible to maintain on a level conductive efficiency between support element 17 and movable contact element 22, to reduce the electric resistance during rocking of movable contact element 22, and to suppress the generation of arc in the contacting portions by sliding contact and separation of both contacts 12 and 31. Accordingly, it is possible to prevent melting of the contacts during on and off action of the switch and substantially extend the life of the switch.

When actuator 4 is pushed down at the elevated end in the right, actuator 4 turns to the clockwise direction and operation arm 33 causes side pieces 29 to turn to the left. Similarly, terminal piece 28 turns to the left. Thus, movable contact 12 contacts with stationary contact 31 to close the electric circuit.

In the embodiment stated above, the coil spring is used as an elastic element, since the coil spring makes unity of elasticity easy. However, the elastic element is not limited to the coil spring. For example, the elastic element may be a cylindrical body of synthetic resin, a leaf spring of metal, or a profile-memory alloy spring.

Figure 7:
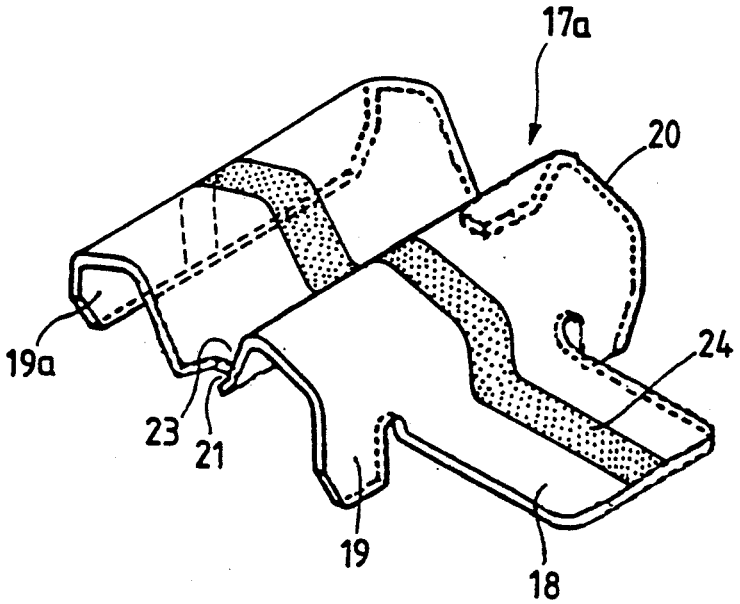
FIG. 7 is a perspective view of another embodiment of the support element.
Figure 8:
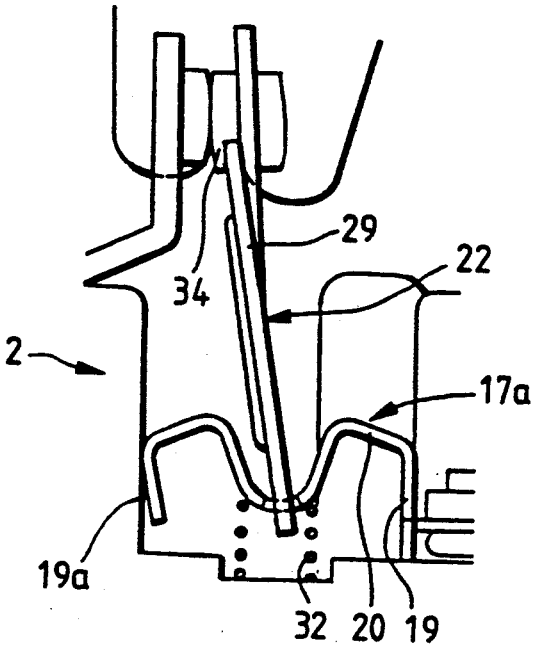
FIG. 8 is an explanatory view of operation of the support element shown in FIG. 7.

FIGS. 7 and 8 show a second embodiment of the switch of this invention. FIG. 7 is a perspective view of support element 17*a* and FIG. 8 is an explanatory view of operation of support element 17*a*. In this embodiment, support element 17*a* comprises connecting piece 18 and leaf spring generally formed into an M-shaped form. The leaf spring has V-shaped piece 20 and legs 19, 19*a* connected to the opposite sides of V-shaped piece 20. Connecting piece 18 is connected to the side of leg 19. Leg 19*a* is shorter than leg 19 to define a space between leg 19*a* and bottom of lower member 2 (see FIG. 8). This provides V-shaped piece 20 with elasticity having a large value in the vertical direction but a small value in the lateral direction. Support element 17*a* has clad layer 24 as mentioned above.

Figure 9:
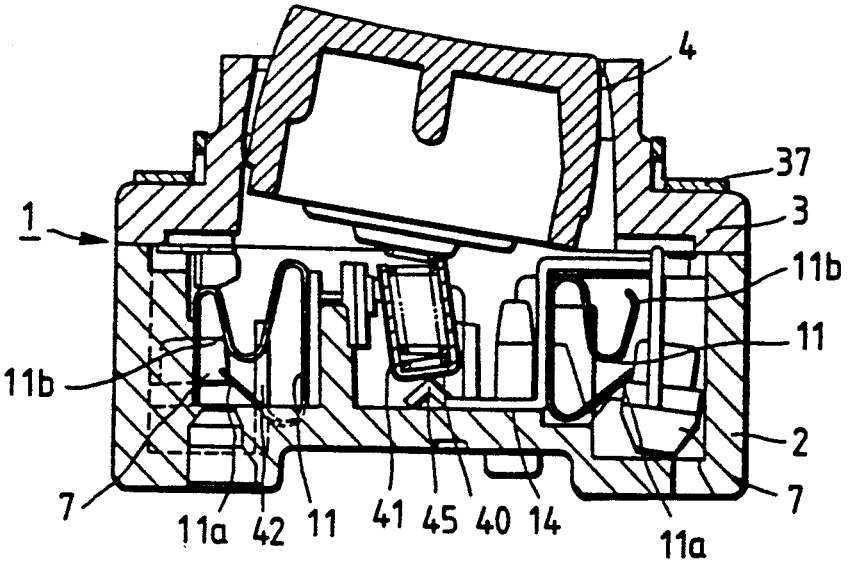
FIG. 9 is a longitudinal cross section of a switch of another embodiment in accordance with this invention.
Figure 10:
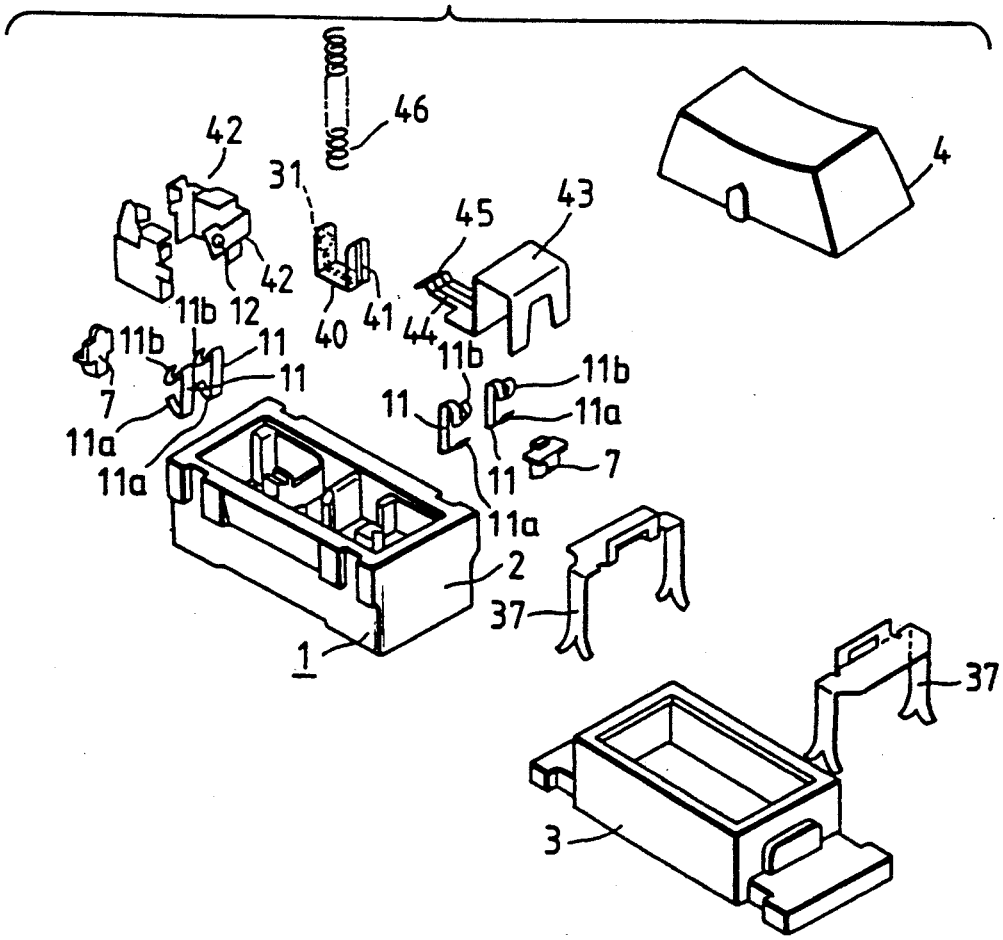
FIG. 10 is an exploded perspective view of FIG. 9.

FIGS. 9 and 10 shows a third embodiment of the switch of this invention. FIG. 9 is a longitudinal cross section of the switch and FIG. 10 is a decomposed perspective view of FIG. 9.

In this embodiment, clad layer 41 is formed on the back surface of movable contact element 40 which rocks by the actuator.

Connecting contact element 42 is provided with stationary contact 12 while connecting contact element 43 is provided with contact plate 44 having protrusion 45 (support element) which supports movable contact element 40 rockably. Spring 46 is disposed between actuator 4 and movable contact element 40 in the compressed condition.

The other construction and operation of this embodiment are the same as those of the embodiments stated above. This embodiment can obtain the same effects as those of the embodiments stated above.

In the embodiments mentioned above, clad layers 24 and 41 are formed on either movable contact element or support element. However, clay layers may be formed on both upper face of said support element and lower face of said movable contact element.

Preferably, clay layers 24 and 41 extend to securing element 25 in the first and second embodiments and extend to movable contact 31 in the third embodiment to improve the conductivity.

The present invention can obtain the following effects. It is possible to maintain on a high level conductive efficiency between the support element and the movable contact element and to reduce the electric resistance during rocking of the movable contact element. Thus the life of the switch can be substantially extended. In addition, since the switch of this invention comprises the housing having the upper and lower members, switch means having the movable contact element provided with the movable contact, the support element, and the elastic element, and the connecting terminal elements for the external electric wires, it is possible to suppress the generation of heat in the engaged portions, to increase the durability and reliability of the contacts, to prevent the melting of the contacts, and to assure the positve on and off action. Also, the assembling work becomes very simple, since the composing parts are assembled successively.

I claim:

1. A switch comprising:

a housing having an upper housing member and a lower housing member;

an actuator disposed in said housing and rockably supported on said upper housing member;

switch means responsive to said actuator for switching a movable contact in and out of contact with a stationary contact in accordance with rocking of the actuator; and a connecting terminal connected to said switch means and adapted to cooperate with an external electric wire;

wherein said switch means comprises:

a movable contact element having said movable contact disposed thereon, and support means for rockably supporting said movable contact element, wherein at least one of contacting portions of the movable contact elements and the support means which contact each other is provided with a clad layer of a highly conductive noble metal extending in a rocking direction of the actuator at a width less than that of the contacting portions; and wherein said support means includes a leaf spring comprising a connecting piece, legs extending downwardly from an end of said connecting piece, and a V-shaped piece connected to an upper portion of said legs, wherein said legs provide said V-shaped piece with elasticity.

2. A switch according to claim 1 wherein said clad layer is formed on the upper face of said support element at the width less than that of the portion contacting with said movable contact element.

3. A switch according to claim 1 wherein said clad layer is formed on the lower face of said movable contact element.

4. A switch according to claim 1 wherein said clad layer is formed on both upper face of said support element at the width less than that of the portion contacting with said movable contact element and lower face of said movable contact element.

5. A switch comprising:

a housing having a upper housing member and a lower housing member;

an actuator disposed in said housing and rockably supported on said upper housing member;

switch means responsive to said actuator for switching a movable contact in and out of contact with a stationary contact in accordance with rocking of the actuator; and a connecting terminal connected to said switch means and adapted to cooperate with an external electric wire;

wherein said switch means comprises:

a movable contact element having said movable contact disposed thereon, and support means for rockably supporting said movable contact element, wherein at least one of contacting portions of the movable contact elements and the support means which contact each other is provided with a clad layer of a highly conductive noble metal extending in a rocking direction of the actuator at a width less than that of the contacting portions;

wherein said support means includes a leaf spring comprising a connecting piece, legs extending downwardly from an end of said connecting piece, and a V-shaped piece connected to an upper portion of said legs, wherein said legs provide said V-shaped piece with elasticity; and wherein said leaf spring is bent into an M-shaped body to form legs at both sides of said V-shaped piece so as to provide said V-shaped piece with elasticity having a large value in the vertical direction but a small value in the rocking direction.

* * * * *